US005257654A

United States Patent [19]

Bean et al.

[11] Patent Number: 5,257,654

[45] Date of Patent: Nov. 2, 1993

[54] BISCUIT JOINER WITH RETRACTABLE ANTISKID PINS

[75] Inventors: Frederick R. Bean, Finksburg; Glenn A. Pettet, Mt. Arie; Scott D. Price, Pylesville, all of Md.

[73] Assignee: Black & Decker Inc., Newark, Del.

[21] Appl. No.: 887,729

[22] Filed: May 22, 1992

[51] Int. Cl.[5] ..... B27M 1/00

[52] U.S. Cl. ..... 144/136 C; 269/54.1; 279/123; 144/134 D; 144/371; 408/97; 408/241 R; 409/182; 409/190

[58] Field of Search ..... 279/123; 269/54.1; 83/875; 408/95, 97, 72 R, 72 B, 115 R, 115 B, 241 R; 409/175, 178, 182, 190; 144/134 R, 134 D, 136 R, 136 C, 371; 30/374, 375, 377

[56] References Cited

U.S. PATENT DOCUMENTS

| | | | |
|---|---|---|---|
| 347,676 | 8/1886 | White . | |
| 1,844,616 | 2/1932 | Whiton . | |
| 2,378,423 | 6/1945 | Menchaca . | |
| 2,765,825 | 10/1956 | Neilson . | |
| 2,918,953 | 12/1959 | Wraight . | |
| 2,919,925 | 1/1960 | Snyder et al. . | |
| 3,028,170 | 4/1962 | Norrick . | |
| 3,104,689 | 9/1963 | Piper et al. . | |
| 3,211,464 | 10/1965 | Mott et al. . | |
| 4,592,682 | 6/1986 | Vanistendael . | |
| 4,858,663 | 8/1989 | Boston et al. | 409/182 |
| 4,913,204 | 4/1990 | Moores et al. . | |
| 4,926,916 | 5/1990 | Legler et al. | 144/137 |
| 4,947,908 | 8/1990 | O'Banion et al. . | |

FOREIGN PATENT DOCUMENTS 2838233 7/1979 Fed. Rep. of Germany .

OTHER PUBLICATIONS

Elu Woodworking Tools by Black & Decker Catalog, Form No. 11345, published 1987 by Black & Decker (U.S.) Inc., Hunt Valley, Md, pp. 10 and 11 Supplemental Drawing for 3380 Joiner/Spliner.

*Primary Examiner*—W. Donald Bray

*Attorney, Agent, or Firm*—Dennis A. Dearing; John D. Del Ponti; Charles E. Yocum

[57] ABSTRACT

A biscuit joiner 11 has a pair of selectively usable retractable antiskid pin subassemblies 13, 15 for increasing the frictional resistance of the shoe assembly 23 with a workpiece when making a cut in the workpiece. Pins 19, 21 are biased forwardly to an extended position by a spring 45. To permit selective use of the pins 19, 21, a retractor 47 retains pins 19, 21 in a retracted position. Retractor 47 preferably comprises a cam 59 and a cam follower 61 and is actuated and deactuated by rotation of pins 19, 21 within chambers 43. Each pin tip 55 has a plurality of peripheral points 73-76 which are particularly effective for reducing skidding on a workpiece.

9 Claims, 6 Drawing Sheets

BISCUIT JOINER WITH RETRACTABLE ANTISKID PINS

FIELD OF THE INVENTION

This invention relates to biscuit joiners for cutting slots in workpieces for forming biscuit joints and more particularly to antiskid pins for stabilizing the location of the joiner relative to the workpiece when cutting a slot in the workpiece.

BACKGROUND OF THE INVENTION

As depicted in FIGS. 9A, 9B, joints between two workpieces, e.g. two pieces 211, 213 of wood when making furniture, can be made by gluing a thin, wooden wafer 215 ("biscuit" or "spline") in the two workpieces 211, 213. To do this, a similar size slot 217, 219 is made in each workpiece 211, 213 and glue is applied in the slots 217, 219 and/or on wafer 215. The wafer 215 is inserted in one slot to approximately one-half the width of the wafer. Then the two workpieces 211, 213 are then clamped together until the glue sets. If desirable, several such wafers 215 can be inserted into a mating slot 217, 219 in each workpiece 211, 213 at spaced locations throughout the joint. All such wafers are partly assembled in one of the workpieces before the two workpieces 211, 213 are clamped together.

Portable power tools, commonly known as biscuit or plate joiners, have been developed for making the wafer receiving slots by plunge cutting. As shown in U.S. Pat. No. 4,913,204, the plunge cut can be made by reciprocally moving along a linear path a motor housing relative to a shoe assembly of the joiner to cause a circular blade to protrude forwardly through and to retract rearwardly through an opening in the shoe assembly. In another known type, the plunge cut is made by reciprocally pivoting a motor housing relative to a shoe assembly of the joiner to cause a circular blade to protrude forwardly through and to retract rearwardly through an opening in the shoe assembly. In another known type of joiner described in U.S. Pat. No. 4,947,908, a motor housing is pivotally mounted relative to a shoe assembly and the cut is made by sweeping, rather than plunging, an elongated, generally cylindrical bit through an opening in the shoe assembly.

In all of the foregoing joiner types, when making the cut, lateral forces are imposed on the workpiece by the blade or cutter tending to cause the workpiece to slide relative to the shoe assembly. In the circular blade joiners, the rotation of the blade generates the lateral forces. In the cylindrical bit joiners, the sweeping action of the bit into the workpiece causes the lateral forces. Thus for accuracy, these lateral forces must be overcome to retain the shoe assembly in a fixed location on the workpiece when the cut is made. In prior art joiners, a number of different mechanisms have been used to increase the lateral stability of the joiner shoe relative to the workpiece. One mechanism is a retractable spring biased metal pin which is embedded in the workpiece when the shoe is engaged with the workpiece to make a cut. Other known mechanisms have a rubber coated or sand paper coated shoe surface for engaging the workpiece. See, for example, U.S. Pat. No. 4,947,908 (FIG. 10). In another mechanism, rubber plugs are inset in and project from a shoe surface for engaging the workpiece.

These prior art mechanisms suffer from certain disadvantages. The spring biased metal pin while increasing the lateral stability of the joiner is not preferred by some users because the pin can permanently damage the workpiece if inadvertently engaged with an exposed surface of the workpiece. Also, the pin restricts the sliding of the joiner relative to the workpiece when positioning the joiner relative to the workpiece at the desired location for making a cut. The rubber coated or sand paper coated mechanisms and the rubber plugs are disadvantageous because they provide less lateral stability of the joiner on the workpiece. And, therefore, these mechanisms have a greater tendency to permit relative sliding between the joiner and the workpiece when making a cut. This is particularly true if the shoe and workpiece surfaces are dusty.

SUMMARY OF THE INVENTION

A primary object of the present invention is to provide a biscuit joiner with a selectively usable mechanism for increasing the lateral stability of a biscuit joiner on a workpiece when making a cut.

According to one aspect, the present invention provides a biscuit joiner comprising a motor housing and a shoe assembly including a rotatably driven cutter. The shoe assembly has a front wall and a cutter opening formed in the front wall. The housing is movable to and fro relative to the shoe assembly to cause the cutter to protrude forwardly through and to retract rearwardly through the cutter opening. The shoe assembly comprises a retractable antiskid pin subassembly for selectively engaging a workpiece engaged with the front wall. The subassembly comprises a chamber, a pin, a spring and a retractor. The pin is slidably mounted between an extended position in which the pin tip projects forwardly through an aperture in the chamber and a retracted position in which the tip is retracted fully within the chamber rearwardly of the aperture. The spring biases the pin forwardly to the extended position. To permit selective use of the antiskid pin, a retractor is fixed in the shoe assembly and is slidable back and forth between an actuated and a deactuated position for moving the pin back and forth between the retracted and the extended positions by compressing and extending the spring.

The retractor may comprise a cam and a cam follower. The cam and cam follower are formed on the chamber sidewall and the pin sidewall respectively. The cam follower preferably comprises a plurality of spaced lobes. The cam preferably comprises a plurality of alternating peaks and valleys forming a track for the cam follower. When the respective valleys and lobes are engaged, the pin is located in an extended position. When the respective peaks and lobes are engaged, the pin is located in a retracted position. The extended and retracted positions of the pin correspond, respectively, to the deactuated and actuated positions of the retractor.

According to another aspect, the present invention provides a biscuit joiner comprising a motor housing and a shoe assembly including a rotatably driven cutter. The shoe assembly has a front wall and a cutter opening formed in the front wall. The housing is movable to and fro relative to the shoe assembly to cause the cutter to protrude forwardly through and to retract rearwardly through the cutter opening. The shoe assembly comprises a first antiskid pin subassembly for engaging a workpiece engaged with the front wall. The subassembly comprises a chamber, a pin and a spring. The pin is slidably mounted between an extended position in which the pad tip projects forwardly through an aperture in the chamber and a retracted position in which the tip is retracted within the chamber rearwardly of the aperture. The spring biases the pin forwardly to the extended position. The pin tip has a plurality of spaced points. Each point has (1) an apex located at the circumference of the tip and (2) an edge extending from the apex toward the longitudinal axis of the pin. And each point is defined by and between adjacent intersecting channels extending generally transverse to the pin axis. The pin tip is particularly effective to prevent skidding on a work surface by increasing the frictional resistance of the pin without increasing the bias force on the pin.

Each channel preferably has a shape defined by a mating generally cylindrical segment.

Additional objects and advantages of the invention will be apparent from the detailed description of the preferred embodiment, the appended claims and the accompanying drawings or may be learned by practice of the invention.

BRIEF DESCRIPTION OF THE DRAWINGS

The accompanying drawings which are incorporated in, and constitute a part of, this specification illustrate one embodiment of the invention and together with the description serve to explain the principles of the invention.

DESCRIPTION OF THE PREFERRED EMBODIMENT

Figure 9A:
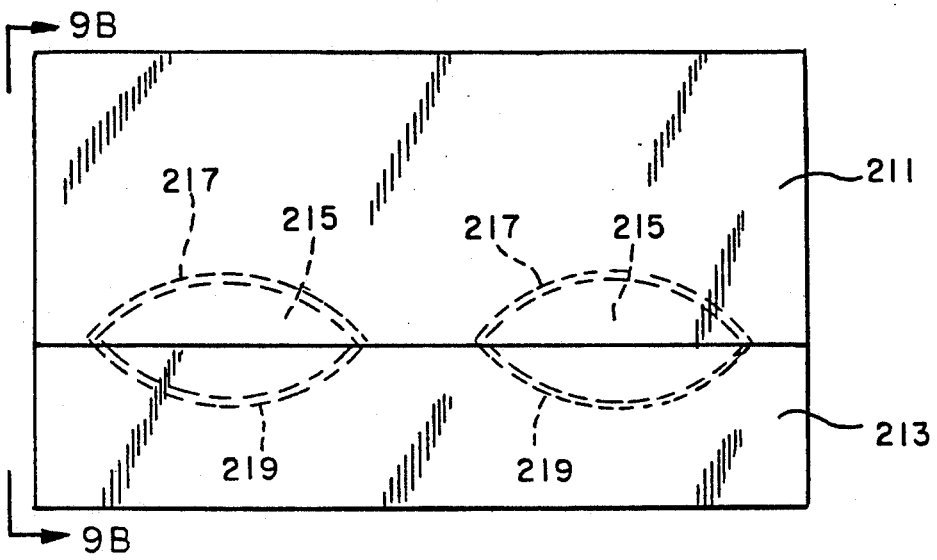
FIG. 9A is a side elevational view taken along line 9A—9A of FIG. 9B and illustrates one type of biscuit joint which may be formed with a joiner of FIG. 1.
Figure 9B:
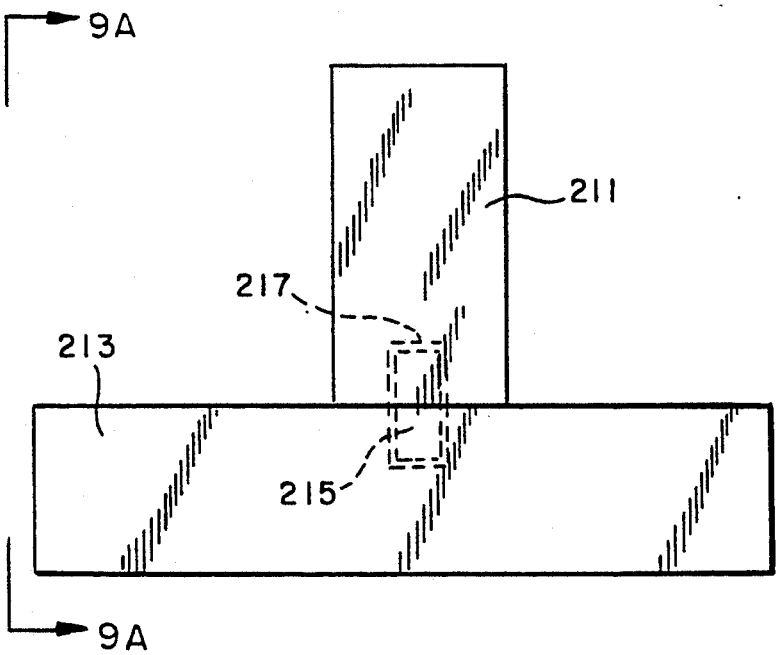
FIG. 9B is a side elevational view taken along line 9B—9B of FIG. 9A.

The preferred embodiment of the invention is a biscuit joiner 11 with retractable antiskid pin subassemblies 13, 15. Pin subassemblies 13, 15 are preferably used on a joiner 11 made in accordance with U.S. Pat. No. 4,913,204 which is assigned to the assignee of the present invention and is incorporated herein by reference. Joiner 11 is used to make segment shaped slots in a workpiece such as shown in FIGS. 9A, 9B by a guided plunge-cutting action of a rotating cutter blade 17. Pins 19, 21 increase the frictional engagement of shoe assembly 23 with the workpiece and aid in preventing joiner 11 from slipping relative to the workpiece when a cut is made. Some end users prefer use of ,pins 19, 21 to enhance the frictional engagement. Others prefer a shoe assembly 23 with a smooth front wall 25 to avoid damaging the workpiece. The present invention provides improved pin subassemblies 13, 15 which are selectively usable to satisfy both end user preferences.

Figure 1:
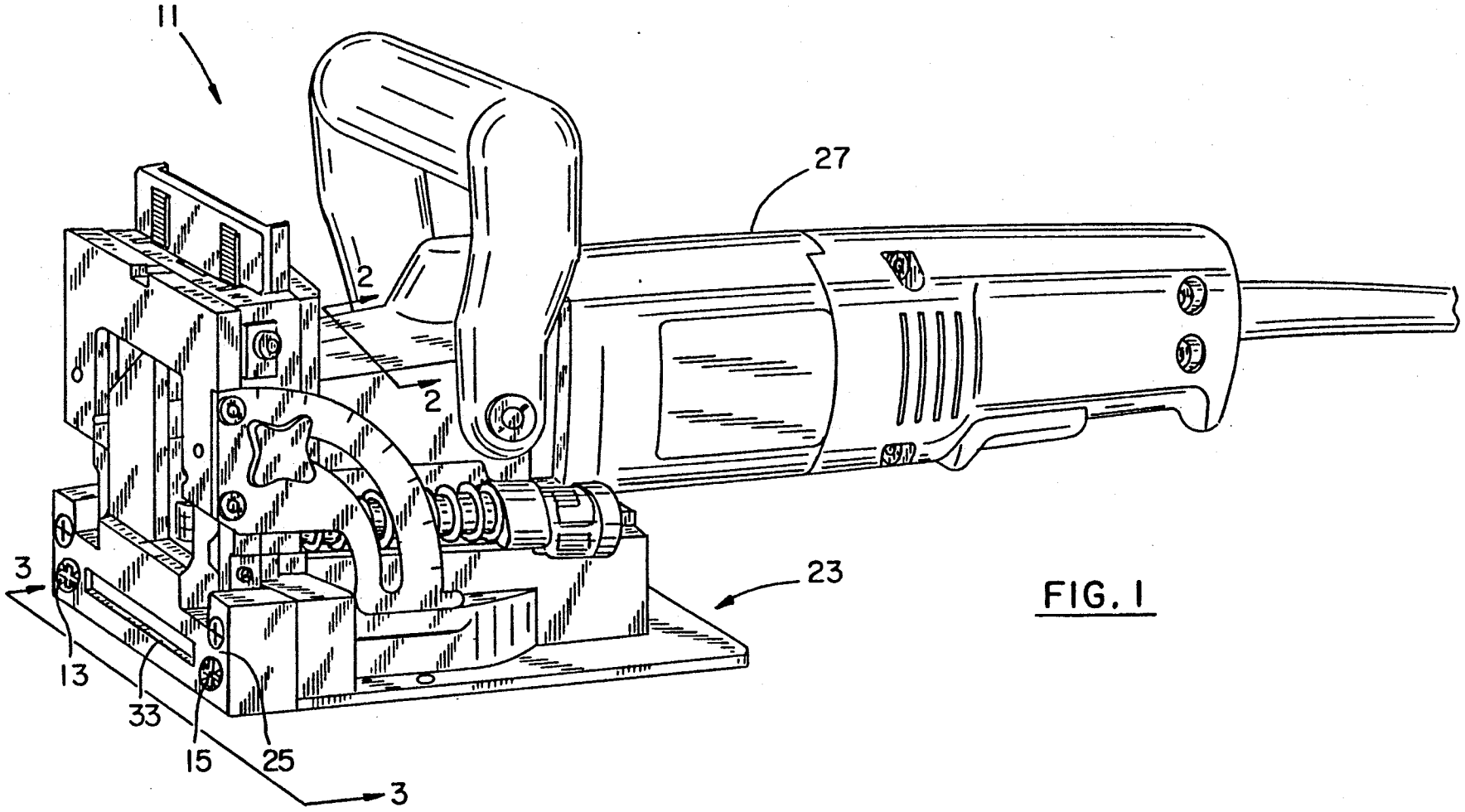
FIG. 1 is a perspective view of a biscuit joiner in accordance with the present invention.
Figure 2:
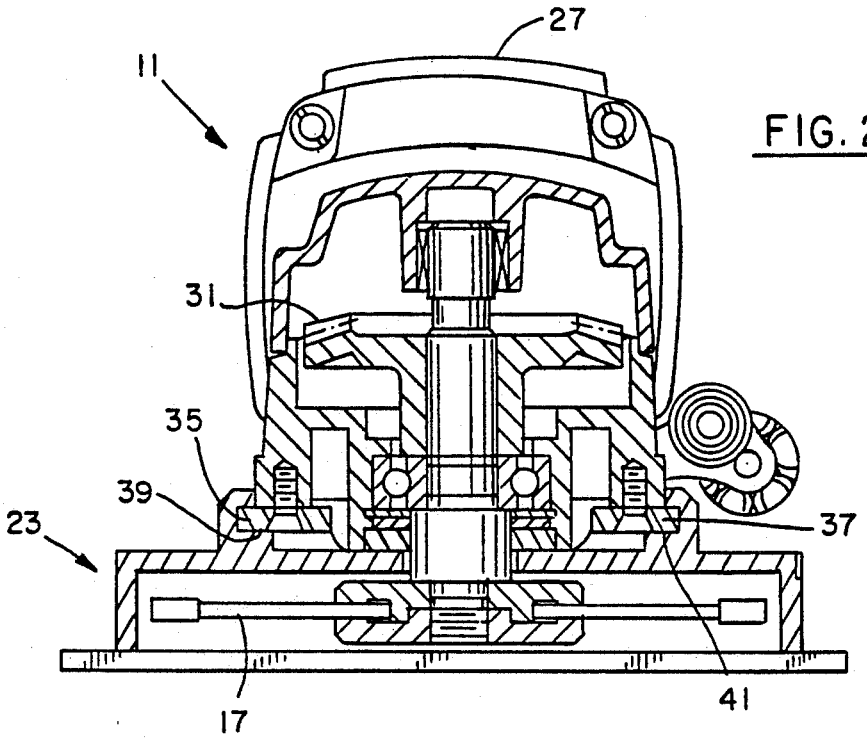
FIG. 2 is a cross-sectional view taken along line 2—2 of FIG. 1.
Figure 3:
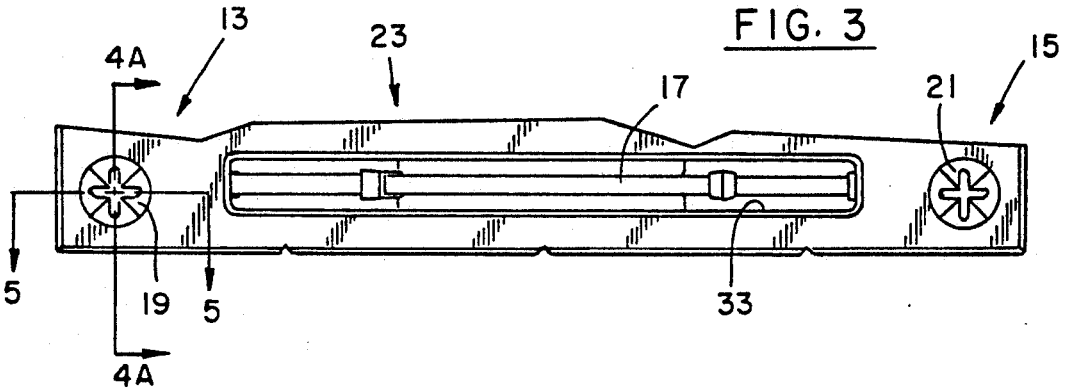
FIG. 3 is a fragmentary front elevational view taken along line 3—3 of FIG. 1.

In accordance with the invention, as shown in FIGS. 1, 2, joiner 11 comprises a motor housing 27 including a motor (not shown). Shoe assembly 23 includes cutter blade 17 rotatably driven by the motor (not shown) through a bevel gear train 31. An opening 33 is formed in front wall 25 of assembly 23 through which blade 17 is protrudable in a forward direction and retractable in a rearward direction. Housing 27 is movable back and forth relative to shoe assembly 23 to cause blade 17 to protrude forwardly through and to retract rearwardly through opening 33. As embodied herein, movement of housing 27 relative to shoe assembly is guided by a pair of flanges 35, 37 which are fixed to housing 27 and are slidably mounted in linear guideways 39, 41 formed longitudinally in shoe assembly 23. Alternatively, the motor housing may be pivoted relative to the shoe assembly to permit the blade to project and retract through an opening in the shoe assembly.

In accordance with the invention, as shown in FIGS. 3–8, shoe assembly 23 further comprises a retractable antiskid pin subassembly 13 for selectively engaging a workpiece engaged with front wall 25. The pin subassembly comprises a chamber 43, pin 19, a bias spring 45 and a retractor 47. Chamber 43 has an aperture 49, a chamber sidewall 51 and an axis 53 extending through aperture 49. The pin 19 comprises a tip 55 and a pin sidewall 57. Pin 19 is slidably mounted between an extended position (FIG. 4A) in which the tip projects forwardly through aperture 49 and a retracted position (FIG. 4B) in which tip 55 is retracted fully within chamber 43 rearwardly of aperture 49. Spring 45 biases pin 19 forwardly to the extended position. To permit selective use of pin 19, retractor 47 is fixed in the shoe assembly and is slidable back and forth between an actuated and a deactuated position for moving the pin back and forth between the retracted and the extended positions by compressing and extending the spring.

As embodied herein, as shown in FIGS. 4–8, retractor 47 preferably comprises (1) a cam 59 formed on one of the chamber sidewall 51 and pin sidewall 57 and (2) cam follower 61 formed on the other of the chamber sidewall 51 and the pin sidewall 57. Preferably, cam 59 is formed on chamber sidewall 51 and cam follower 61 is formed on pin sidewall 57. As will be recognized, the locations of cam 59 and cam follower 61 may be interchanged between the chamber and pin sidewalls 51, 57.

Figure 4A:
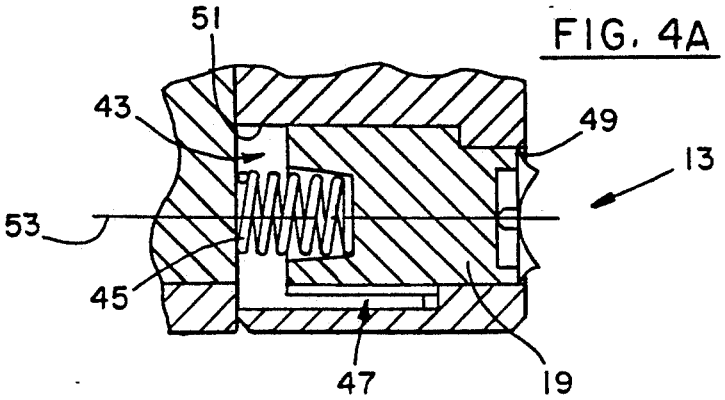
FIG. 4A is a cross-sectional view taken along line 4A—4A of FIG. 3 and illustrates a pin subassembly of the present invention with the pin of the subassembly in an extended position.
Figure 4B:
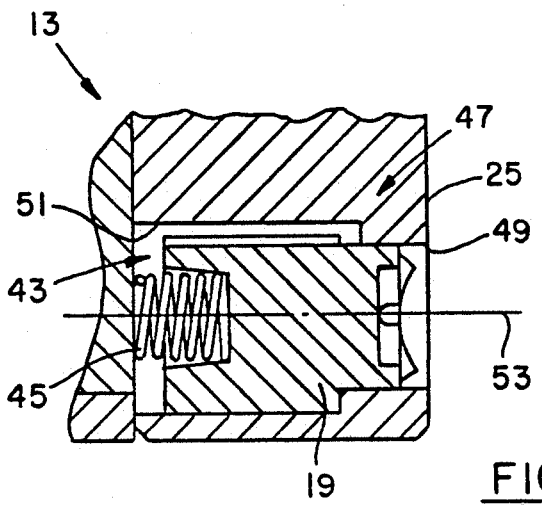
FIG. 4B is a cross-sectional view identical to FIG. 4A except that the pin is shown in the retracted position.
Figure 5:
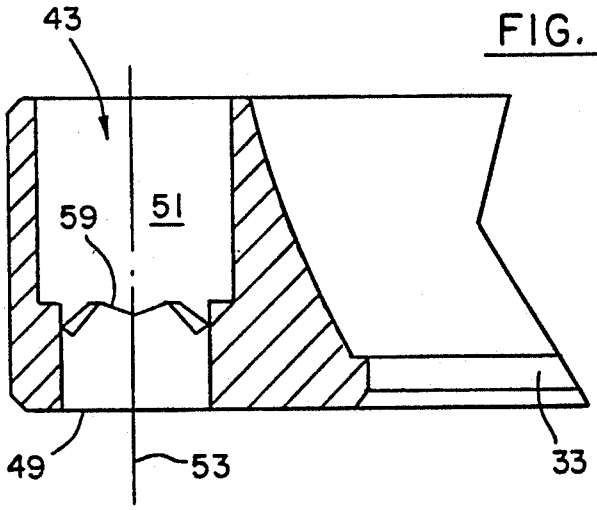
FIG. 5 is a cross-sectional view taken along line 5—5 of FIG. 3 and illustrates the pin subassembly with the pin removed.
Figure 6:
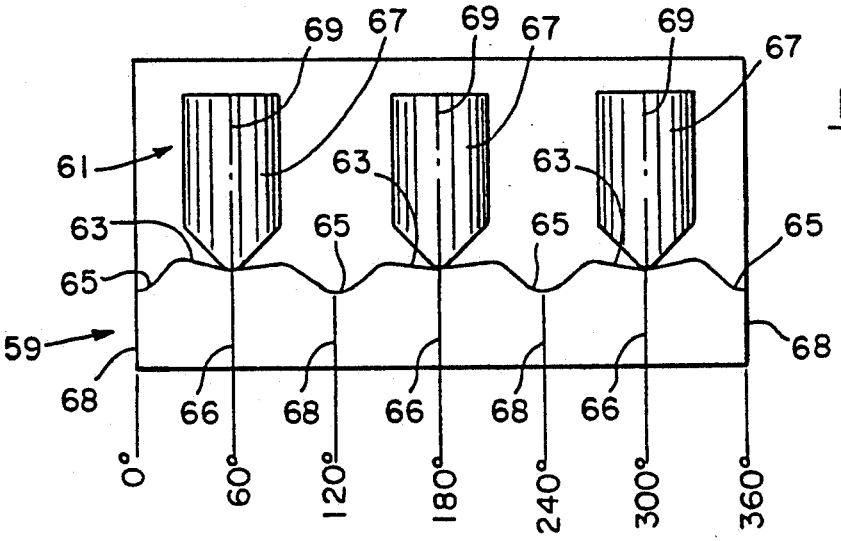
FIG. 6 is a schematic illustration of the flat pattern of a retractor cam and cam follower showing the pin retractor in the actuated position.
Figure 7:
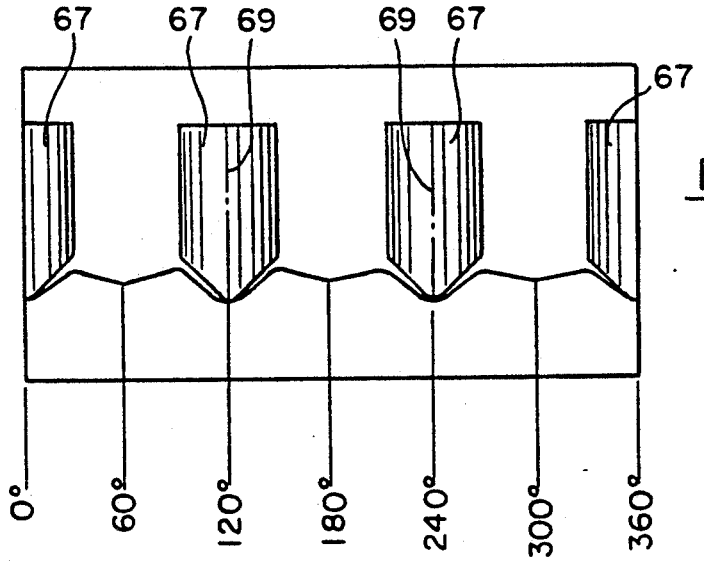
FIG. 7 is a schematic illustration of the flat pattern of a retractor cam and cam follower showing the pin retractor in the deactuated position.

FIGS. 6 and 7 schematically illustrate the flat pattern of cam 59 and cam follower 61 and further show, respectively, the relative positions of cam 59 and cam follower 61 when retractor 47 is in the actuated position (FIG. 6) and in the deactuated position (FIG. 7). Cam 59 comprises a plurality of alternating peaks 63 and valleys 65 forming a track for cam follower 61. The axes of symmetry 66, 68 of adjacent peaks and valleys are spaced at 60° intervals. Cam follower 61 is formed by a plurality of spaced lobes 67 having center lines 69 spaced at 120° intervals around sidewall 57. As shown in FIGS. 4A, 7, when the respective lobes 67 and valleys 65 are engaged, pin 19 is located in the extended position to form the deactuated position of retractor 47. As shown in FIGS. 4B, 6, when the respective lobes 67 and peaks 63 are engaged, pin 19 is located in the retracted position to form the actuated position of retractor 47.

A recess 71 (FIG. 8A) is formed in tip 55 for receiving a tool for rotating pin 19 about chamber axis 53 to change retractor 47 back and forth between the actuated and deactuated positions. A screwdriver or other similarly shaped objects can be used to rotate pin 19.

Figure 8A:
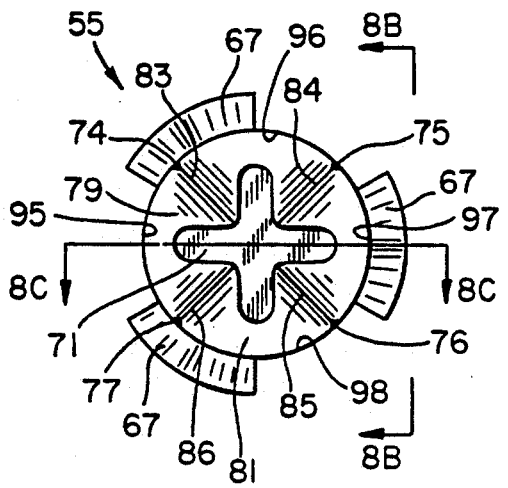
FIG. 8A is a front elevational view of the pin assembly of the present invention.
Figure 8B:
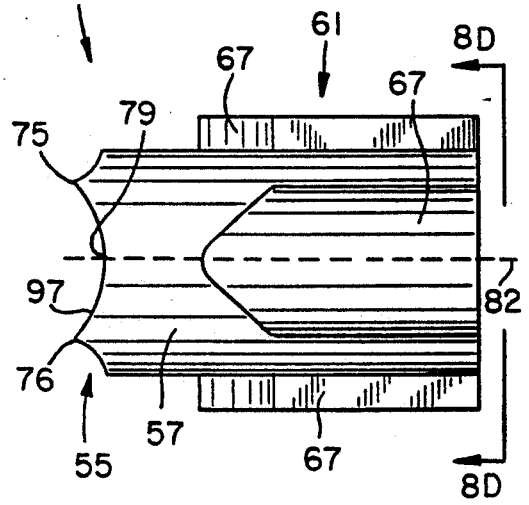
FIG. 8B is a side elevational view of FIG. 8A.
Figure 8C:
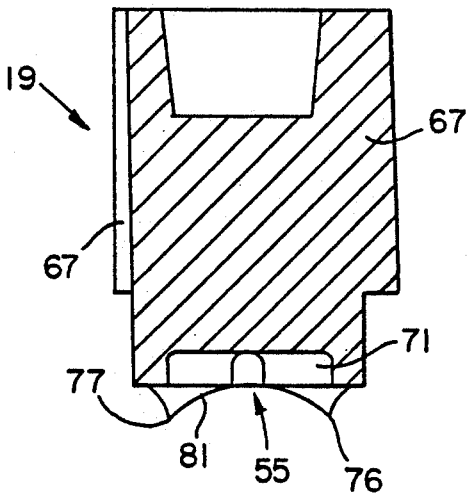
FIG. 8C is a cross-sectional view taken along line 8C—8C of FIG. 8A.
Figure 8D:
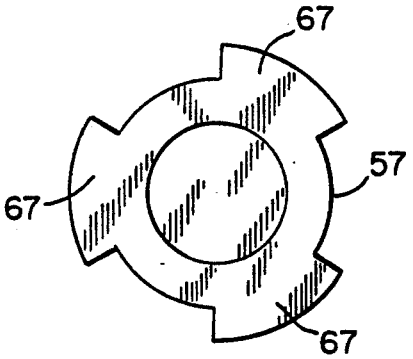
FIG. 8D is a rear elevational view taken along line 8D—8D of FIG. 8B.

According to another aspect, as shown best in FIGS. 8A–8C, the present invention provides a pin tip which is particularly effective to prevent skidding on a work surface by increasing the frictional resistance of pin 19 without increasing the bias force on pin 19. Tip 55 has a plurality of spaced points 73–76 defined by and between adjacent intersecting channels 79, 81 which extend generally transverse to the longitudinal axis 82 of pin 19 and intersect pin axis 82. Each point 73–76 has an apex located at the circumference of tip 55 and has a sheared edge 83–86 extending from the apex toward longitudinal axis 82 of pin 19 coinciding with chamber axis 53.

As embodied herein, each channels 79, 81 preferably has a shape defined by a mating generally cylindrical segment (not shown). The description of each channel 79, 81 as being defined by a mating cylindrical segment is based on the fact that for channel 79, the circumferential edges 95, 97 (FIGS. 8A, 8B) between adjacent points 74, 77 and adjacent points 75, 76, respectively, would extend only a small distance around the circumferential sidewall of a mating cylinder. Similarly for channel 81, circumferential edges 96, 98 extend only a small distance around the circumferential sidewall of a mating cylinder. Each mating cylinder is oriented to have its longitudinal axis of symmetry perpendicular to and intersecting pin axis 82. Other solid shapes having a cross-sectional shape (e.g., hexagonal and octagonal) may be used in lieu of a cylinder. A solid with a triangular cross-section may be used also by orienting the solid to have a bisector of an apex angle of the triangular cross-sectional faces parallel to the pin axis 82.

The pin tip 55 is advantageous and is particularly effective to reduce skidding for a number of reasons. First, the arrangement of the point apexes at the circumference of pin tip 55 allows the point apexes to penetrate a workpiece easily and securely while leaving the central portion of pin tip 55 open for the formation of tool receiving recess 71. Secondly, curved circumferential edges 95–98 between adjacent points are aggressive and are effective in reducing skidding. Thirdly, the bias force applied by spring 45 is divided among points 73–76 rather than being applied to a single conical tip as in certain prior art designs. Thus, each point 73–76 usually penetrates a workpiece surface. But, if one point 73–76 fails to penetrate because of, e.g., a knot; the remaining points may prevent skidding. Lastly, the inward and rearward orientation of edges 83–86 forming a concave pin tip 55 contributes to the ease of adjustment of the pin from an extended to a retracted position using a variety of tool shapes.

To provide durability and increased frictional resistance, pin 19 is made of a hard material. The preferred material is powdered metal which provides the requisite hardness and permits the relatively complex shape of pin 19 to be formed at a relatively low cost.

As embodied herein, pin subassembly 13 is located adjacent to one end of elongated opening 33. A second pin subassembly 15 constructed identically to pin assembly 13 is located adjacent to the other end of opening 33. One or more such subassemblies may be used in the practice of the present invention.

In operation, to change pin 19 from an extended position (FIG. 4A and FIG. 7) to a retracted position (FIG. 4B and FIG. 6), a screwdriver is inserted in recess 71 and pin 19 is rotated (in either direction) about axis 53 through a 60° angle. Spring 45 retains the lobes 67 in spring biased engagement with cam track 59. And as pin 19 is rotated, pin 19 slides back and forth within chamber 43 between the extended and retracted positions. In the extended position, lobes 67 engage valleys 65. Through the rotation of pin 19, lobes 67 are resiliently slid relative to cam 59 until lobes 67 are centrally located on peaks 67 as shown in FIG. 6. Similarly to change pin 19 from a retracted position to an extended position, pin 19 is rotated through another 60° angle to restore the lobes to a position in which they are centrally resting in valleys 65.

As will be appreciated, the present invention provides a number of advantages compared to prior art antiskid pins. The present invention provides antiskid pins 19, 21 which have a stable retracted position (FIG. 4B) and a stable extended position (FIG. 4A) permitting the pins to be selectively used based on end user preference and the workpiece application. Because use of antiskid pins 19, 21 is selective, pins 19, 21 may be made of sharp, durable material which penetrate the workpiece when use is desired. And, when use is not desired, pins 19, 21 may be located in a retracted position to prevent scarring of the workpiece. Secondly, the cam retractor 47 is self contained within the chamber 43 of the pin subassembly providing a compact reliable mechanism. Finally, aided by the concave configuration of pin tip 55, pins 19, 21 may be changed back and forth between an extended and retracted position simply with a variety of tools.

It will be apparent to those skilled in the art that various modifications and variations can be made in the joiner of the present invention without departing from the scope or spirit of the invention. For example, the pin subassemblies 13, 15 may be used in a biscuit joiner as disclosed in U.S. Pat. No. 4,947,908 discussed in the Background of the Invention above. Thus, it is intended that the present invention cover these modifications and variations provided they come within scope of the appended claims and their equivalents.

We claim:

1. A biscuit joiner comprising:

a motor housing;

a shoe assembly including a rotatably driven cutter blade;

a shoe assembly having a front wall and a blade opening formed in the front wall;

the housing relatively movable to and fro relative to the shoe assembly to cause the blade to protrude forwardly through and to retract rearwardly through the opening;

the shoe assembly comprising a first retractable antiskid pin subassembly for selectively engaging a workpiece engaged with the front wall, the pin subassembly comprising:

a chamber having an aperture in the front wall, a chamber sidewall and an axis extending through the aperture;

a pin comprising a tip and a pin sidewall;

the pin slidably mounted between an extended position in which the tip projects forwardly through the aperture and a retracted position in which the tip is retracted fully within the chamber rearwardly of the aperture;

a spring for biasing the pin forwardly to the extended position; and a retractor fixed in the shoe assembly and movable back and forth between an actuated and a deactuated position for sliding the pin back and forth between the retracted and the extended positions by compressing and extending the spring.

2. The joiner of claim 1 wherein:

the retractor comprises (1) a cam formed on one of the chamber sidewall and the pin sidewall and (2) a cam follower formed on the other of the chamber sidewall and the pin sidewall.

3. The joiner of claim 2 wherein:

the cam follower is a plurality of spaced lobes; and the cam comprises a plurality of alternating peaks and valleys forming a track;

the engagement of the respective lobes and valleys locates the pin in the extended position; and the engagement of the respective lobes and peaks locates the pin in the retracted position.

4. The joiner of claim 1 wherein:

the retractor has an actuated position in which the pin is located in the retracted position and a deactuated position in which the pin is located in the extended position; and a recess is formed in the pin tip for receiving a tool for rotating the pin about the chamber axis to change the retractor back and forth between the actuated and deactuated positions.

5. The joiner of claim 1 wherein:

the opening is elongated;

the pin assembly is located adjacent to one end of the opening; and a second pin assembly constructed identically to the first pin subassembly is located adjacent to the other end of the opening.

6. The joiner of claim 1 wherein:

the pin tip has a plurality of spaced points formed by intersecting generally cylindrical recesses.

7. A biscuit joiner comprising:

a motor housing;

a shoe assembly including a rotatably driven cutter blade;

a shoe assembly having a front wall and a blade opening formed in the front wall;

the housing relatively movable to and fro relative to the shoe assembly to cause the blade to protrude forwardly through and to retract rearwardly through the opening;

the shoe assembly comprising a first retractable anti-skid pin subassembly for selectively engaging a workpiece engaged with the front wall, the pin subassembly comprising:

a chamber having an aperture in the front wall, a chamber sidewall and an axis extending through the aperture;

a pin comprising a tip, a pin sidewall and a longitudinal axis;

the pin slidably mounted between an extended position in which the tip projects forwardly through the aperture and a retracted position in which the tip is retracted fully within the chamber rearwardly of the aperture;

a spring for biasing the pin forwardly to the extended position; and the pin tip having a plurality of spaced points, each point having an apex located at the circumference of the pin tip and a concave edge extending from the apex toward the longitudinal axis of the pin, each point defined by and between adjacent intersecting generally cylindrical channels extending generally transverse to the pin axis and intersecting the pin axis and each channel forming a concave circumferential edge extending between and forming adjacent point apexes.

8. A biscuit joiner comprising:

a motor housing;

a shoe assembly including a rotatably driven cutter blade;

a shoe assembly having a front wall and a blade opening formed in the front wall;

the housing relatively movable to and fro relative to the shoe assembly to cause the blade to protrude forwardly through and to retract rearwardly through the opening;

the shoe assembly comprising a first retractable anti-skid pin subassembly for selectively engaging a workpiece engaged with the front wall, the pin subassembly comprising:

a chamber having an aperture in the front wall, a chamber sidewall and an axis extending through the aperture;

a pin comprising a tip, a pin sidewall and a longitudinal axis;

the pin slidably mounted between an extended position in which the tip projects forwardly through the aperture and a retracted position in which the tip is retracted within the chamber rearwardly of the aperture;

a spring for biasing the pin forwardly to the extended position;

the pin tip comprising a plurality of spaced points located on the circumference of the tip;

each point defined by and between adjacent intersecting channels extending transverse to the pin axis and intersecting the pin axis, the shape of each channel defined by a generally cylindrical segment; and the pin tip having a tool receiving recess in the center of the pin tip.

9. A biscuit joiner comprising:

a motor housing;

a shoe assembly including a rotatably driven cutter blade;

a shoe assembly having a front wall and a blade opening formed in the front wall;

the housing relatively movable to and fro relative to the shoe assembly to cause the blade to protrude forwardly through and to retract rearwardly through the opening;

the shoe assembly comprising a first retractable anti-skid pin subassembly for selectively engaging a workpiece engaged with the front wall, the pin subassembly comprising:

a chamber having an aperture in the front wall, a chamber sidewall and an axis extending through the aperture;

a pin comprising a tip, a pin sidewall and a longitudinal axis;

the pin slidably mounted between an extended position in which the tip projects forwardly through the aperture and a retracted position in which the tip is retracted fully within the chamber rearwardly of the aperture;

a spring for biasing the pin forwardly to the extended position;

the pin tip having (1) a plurality of spaced points and (2) a central concavity, each point having an apex located at the circumference of the pin tip and an inner edge extending rearwardly from the apex toward the pin axis each point defined by and between adjacent intersecting channels extending generally transverse to the pin axis, and intersecting the pin axis and each channel forming at the intersection with the pin sidewall a circumferential edge, and the circumferential edge extending between and forming adjacent point apexes; and the concavity defined by the inner point edges and extending between and bounded by the circumferential point apexes.

* * * * *